US006734830B1

(12) United States Patent
Bickham

(10) Patent No.: US 6,734,830 B1
(45) Date of Patent: May 11, 2004

(54) PORTABLE ADJUSTABLE STAND FOR SATELLITE DISH ANTENNAS

(76) Inventor: Comazell Bickham, 2777 Woodland Park, #1402, Houston, TX (US) 77082

( * ) Notice: Subject to any disclaimer, the term of this patent is extended or adjusted under 35 U.S.C. 154(b) by 0 days.

(21) Appl. No.: 10/260,131

(22) Filed: Sep. 27, 2002

(51) Int. Cl.[7] ..... H01Q 1/08; H01Q 3/02

(52) U.S. Cl. ..... 343/880; 343/878; 248/910

(58) Field of Search ..... 343/878, 880, 343/881, 882, 892; 248/161, 910, 529; H01Q 1/08, 3/02

(56) References Cited

U.S. PATENT DOCUMENTS

| | | | | | |
|---|---|---|---|---|---|
| 4,783,662 | A | * | 11/1988 | Wirth, Jr. et al. | 343/757 |
| 5,334,990 | A | * | 8/1994 | Robinson | 343/840 |
| 5,526,010 | A | * | 6/1996 | Plunk | 343/882 |
| 5,760,751 | A | * | 6/1998 | Gipson | 343/880 |
| 6,195,066 | B1 | * | 2/2001 | Pegues, Jr. et al. | 343/883 |
| 6,404,405 | B2 | * | 6/2002 | Wanat | 343/892 |

* cited by examiner

*Primary Examiner*—Hoanganh Le
(74) *Attorney, Agent, or Firm*—Kenneth A. Roddy

(57) ABSTRACT

A portable adjustable stand for mounting and supporting a digital satellite dish antenna eliminates the need for drilling holes and physical attachment to the surfaces of a dwelling with screws, bolts, or other fasteners. The stand has a pair of parallel spaced laterally adjustable longitudinal bracket mounting members and a first and second transverse cross member. The longitudinal bracket mounting members are provided with apertures for receiving and securing an existing mounting foot or mounting bracket of a variety of different commercially available satellite dish antennas. When assembled, the bracket at the lower end of the dish mast arm is secured on the longitudinal bracket mounting members inwardly a short distance from one of the transverse cross members and the mast arm extends toward the other transverse cross member. The outer ends of the shorter transverse cross members extend perpendicular to and laterally outward from opposite ends of the longitudinal bracket mounting members to provide lateral support against tipping over and the center of gravity of the mast arm and dish reflector is generally centered over the center of the stand. The stand allows the dish antenna to be placed indoors or outdoors on a horizontal supporting surface, such as the floor of a dwelling, balcony, or patio and can be easily transported from one location to another.

14 Claims, 4 Drawing Sheets

PORTABLE ADJUSTABLE STAND FOR SATELLITE DISH ANTENNAS

BACKGROUND OF THE INVENTION

1. Field of the Invention

This invention relates generally to apparatus for mounting a satellite dish antenna, and more particularly to a portable adjustable stand for mounting a satellite dish antenna which does not require any drilling of holes or physical attachment to the surfaces of a dwelling.

2. Brief Description of the Prior Art

Digital satellite systems (DSS) are growing in popularity. The broad range of channel selections available to the public, pay-per-view movies, and sporting events contribute to the ever-increasing subscriber base. These DSS systems were originally designed with the homeowner in mind and were provided with mounting arrangements for mounting the dish onto the side of a home, rooftop or onto a metal post in the homeowner's yard. Typically, the digital satellite system includes a control box containing the circuitry, a satellite dish antenna approximately 18" to 24" in diameter, and an adjustable arm or mast having a mounting bracket at the lower end thereof for mounting the mast and antenna dish on a supporting surface such as a roof or wall.

The subscriber base for digital satellite systems (DSS) has been increasing rapidly in apartment complexes. Many apartment residents purchase DSS as an alternative to the cable TV provider offered by the apartment leasing company. Apartment leasing companies unable to prevent residents from installing DSS in their complexes have encountered several side effects that have become serious problems.

For example, the drilling and installation that is required to mount the digital satellite system (DSS) may compromise the integrity of the building structures. After a renter moves, the holes drilled to mount the DSS can promote moisture damage and corrosion caused by insects. There are also risks of damage to property by unskilled installers (or renters). There are also risks of injury to persons, if not properly installed, and the aesthetics of the complex may be diminished.

In some communities, the apartment management places restrictions on the installation and mounting of DSS on structures in their apartment complexes, and require the apartment residents to purchase additional insurance.

Some apartment residents, in violation of these restrictions, place their digital satellite receiver dishes on railings and walls. Others create crude stands, such as stands made of a wooden or metal post, an inverted flowerpot, or a bucket filled with cement, for affixing the digital satellite receiver dish. Still others purchase either TV antenna or digital satellite dish tripods that undesirably occupy a large amount of space on a private balcony or small patio.

There are several patents that disclose supports of various constructions and configurations for mounting or supporting digital satellite dish antennas.

Plunk, U.S. Pat. No. 5,526,010 discloses a portable support stand for a small diameter satellite dish having a lower support base comprising a pair of legs having parallel straight portions attached to the bracket at the lower end of the mast arm of the dish with outer ends diverging outwardly from each other and spaced from each other a distance greater than the diameter of the satellite dish for supporting the stand on a horizontal surface in a free standing relation. To stabilize the base support base and minimize overturning, a ballast is positioned over the legs. The ballast may comprise a sand bag, concrete block, a pan filled with sand or water, a plastic water jug, a planter in which soil and flowers are positioned, or other similar devices having a weight of over around 20 pounds.

Wanat, U.S. Pat. No. 6,404,405 discloses an apparatus for releasably mounting a dish satellite antenna in a window jam opening. A mounting board having a length corresponding to the width of the window jam opening and having a width corresponding to the width of the mounting bracket is provided. At least one tensioning member is connected to the mounting board such that tensioning the tensioning member releasably fastens the mounting board within the window jam opening. The apparatus is positioned on the outside of the window and the window can be opened and closed without interference.

Wirth, Jr., et al, discloses a polar mount for a satellite dish antenna having the flattened ends of three metal tubes bolted together to form a triangular base having three corners. Three tubular leg members have their corresponding lower flattened ends joined to the respective corners of the base. One leg member constitutes the polar axis shaft. The other two leg members are telescopic and adjustable in length. The upper ends of the two telescopic leg members and the upper end of the polar axis shaft are connected at a common point to create a pyramid-shaped structure.

The present invention is distinguished over the prior art in general, and these patents in particular by a portable adjustable stand for mounting and supporting a digital satellite dish antenna that eliminates the need for drilling holes and physical attachment to the surfaces of a dwelling with screws, bolts, or other fasteners. The stand has a pair of parallel spaced laterally adjustable longitudinal bracket mounting members and a first and second transverse cross member. The longitudinal bracket mounting members are provided with apertures for receiving and securing an existing mounting foot or mounting bracket of a variety of different commercially available satellite dish antennas. When assembled, the bracket at the lower end of the dish mast arm is secured on the longitudinal bracket mounting members inwardly a short distance from one of the transverse cross members and the mast arm extends toward the other transverse cross member. The outer ends of the shorter transverse cross members extend perpendicular to and laterally outward from opposite ends of the longitudinal bracket mounting members to provide lateral support against tipping over and the center of gravity of the mast arm and dish reflector is generally centered over the center of the stand. The stand allows the dish antenna to be placed indoors or outdoors on a horizontal supporting surface, such as the floor of a dwelling, balcony, or patio and can be easily transported from one location to another.

SUMMARY OF THE INVENTION

It is therefore an object of the present invention to provide a portable adjustable stand for mounting a satellite dish antenna that eliminates the need for drilling holes and physical attachment to the surfaces of a dwelling with screws, bolts, or other fasteners.

It is another object of this invention to provide a portable adjustable stand for mounting a satellite dish antenna which is easily adjustable to accommodate the existing mounting bracket or mounting foot of a variety of different commercial satellite dish antennas.

Another object of this invention is to provide a portable adjustable stand for mounting a satellite dish antenna that is lightweight and easily transportable from one location to another.

Another object of this invention is to provide a portable adjustable stand for supporting a satellite dish antenna indoors or outdoors on a horizontal supporting surface, such as the floor of a dwelling, balcony, or patio.

Another object of this invention is to provide a portable adjustable stand for supporting a satellite dish antenna in a stable, freestanding, position on a horizontal supporting surface and does not require ballast to prevent overturning.

Another object of this invention is to provide a portable adjustable stand for mounting and supporting a satellite dish antenna that can be packaged and sold in a small box in a disassembled condition.

A further object of this invention is to provide a portable adjustable stand for mounting and supporting a satellite dish antenna that is easily and quickly assembled and disassembled without special tools.

A still further object of this invention is to provide a portable adjustable stand for mounting and supporting a satellite dish antenna which is simple in construction, inexpensive to manufacture and rugged and reliable in operation.

Other objects of the invention will become apparent from time to time throughout the specification and claims as hereinafter related.

The above noted objects and other objects of the invention are accomplished by a portable adjustable stand for mounting and supporting a digital satellite dish antenna that eliminates the need for drilling holes and physical attachment to the surfaces of a dwelling with screws, bolts, or other fasteners. The stand has a pair of parallel spaced laterally adjustable longitudinal bracket mounting members and a first and second transverse cross member. The longitudinal bracket mounting members are provided with apertures for receiving and securing an existing mounting foot or mounting bracket of a variety of different commercially available satellite dish antennas. When assembled, the bracket at the lower end of the dish mast arm is secured on the longitudinal bracket mounting members inwardly a short distance from one of the transverse cross members and the mast arm extends toward the other transverse cross member. The outer ends of the shorter transverse cross members extend perpendicular to and laterally outward from opposite ends of the longitudinal bracket mounting members to provide lateral support against tipping over and the center of gravity of the mast arm and dish reflector is generally centered over the center of the stand. The stand allows the dish antenna to be placed indoors or outdoors on a horizontal supporting surface, such as the floor of a dwelling, balcony, or patio and can be easily transported from one location to another.

DESCRIPTION OF THE PREFERRED EMBODIMENT

Figure 1:
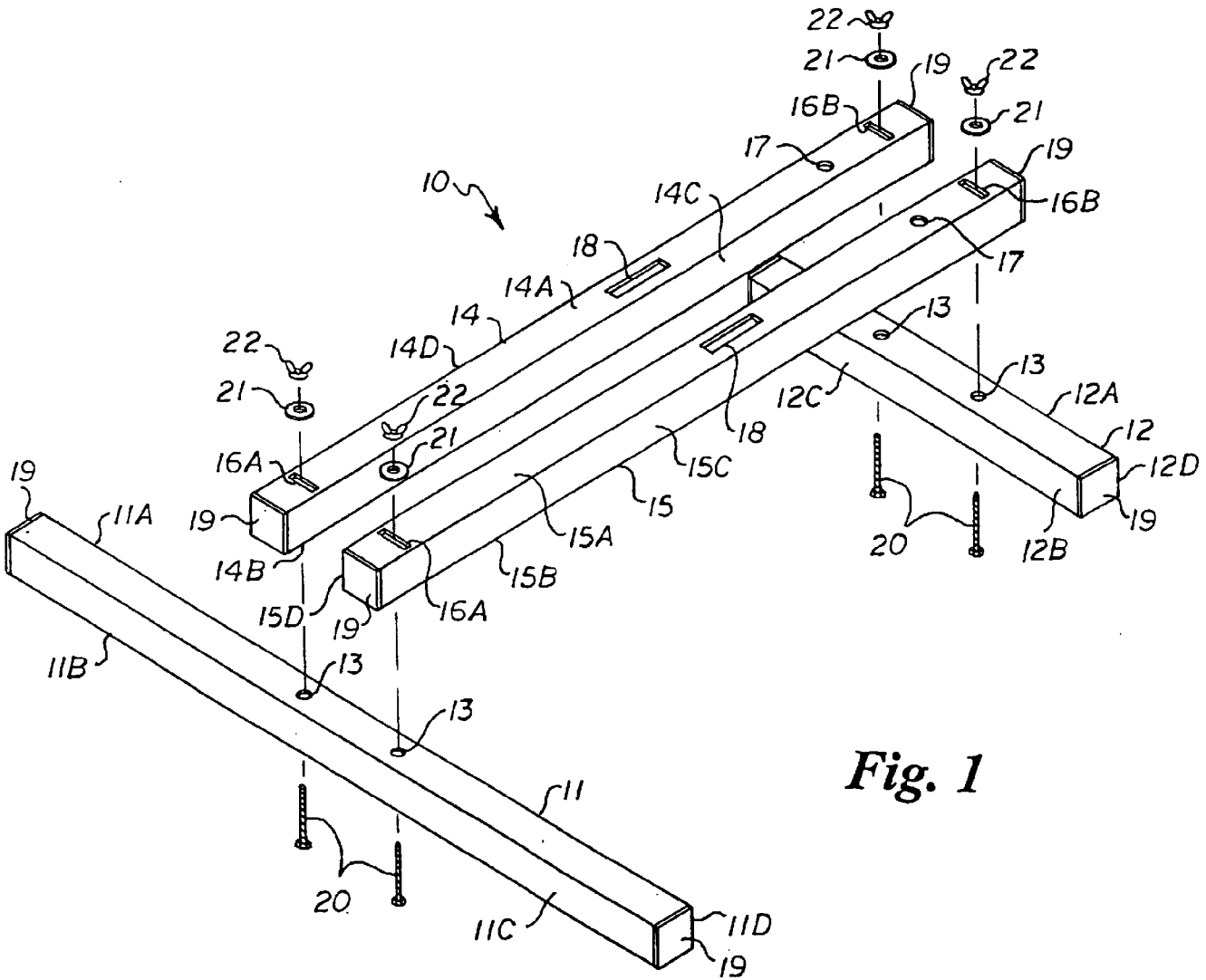
FIG. 1 is an exploded isometric view of the portable adjustable stand for mounting and supporting a satellite dish antenna in accordance with the present invention, shown in a disassembled condition.

Referring to the drawings by numerals of reference, there is shown in FIG. 1, the components of a preferred portable adjustable stand 10 for mounting and supporting a satellite dish antenna, shown in an assembled condition.

The stand 10 includes a first transverse cross member 11 and a second transverse cross member 12. The transverse cross members 11 and 12 are preferably formed of 1¼" square aluminum tubing each having a top wall 11A, 12A, bottom wall 11B, 12B, and lateral side walls 11C, 12C, respectively. The first transverse cross member 11 is approximately 24" in length from end to end, and the second transverse cross member 12 is approximately 12" in length from end to end. A pair of laterally spaced apart holes 13 are formed through the top and bottom walls 11A, 11B and 12A, 12B of the respective first and second transverse cross members 11 and 12 in vertical alignment.

The stand 10 further includes a pair of longitudinal bracket mounting members 14 and 15. The longitudinal bracket mounting members 14 and 15 are preferably formed of 1¼" square aluminum tubing each having a top wall 14A, 15A, bottom wall 14B, 15B, and lateral side walls 14C, 15C, respectively. The longitudinal bracket mounting members 14 and 15 are each approximately 24" in length from end to end. A pair of transverse slots 16A and 16B are formed through the through the top and bottom walls 14A, 14B and 15A, 15B of the respective longitudinal bracket mounting members 14 and 15 in vertical alignment a short distance inwardly from their ends.

A hole 17 is formed through the top and bottom walls 14A, 14B and 15A, 15B of the respective longitudinal bracket mounting members 14 and 15 in vertical alignment a short distance inwardly from the transverse slots 16B. A longitudinal slot 18 is formed through the top and bottom walls 14A, 14B and 15A, 15B of the respective longitudinal bracket mounting members 14 and 15 in vertical alignment a short distance inwardly from holes 17. In a preferred embodiment, the longitudinal slots 18 are approximately 2" long, 5/16" wide and begin approximately 9" from the end of the respective longitudinal bracket mounting members 14 and 15 nearest the holes 17.

Elastomeric end caps 19 are installed in the outer ends the transverse cross members 11 and 12 and longitudinal bracket mounting members 14 and 15. In a preferred embodiment, the transverse cross members 11 and 12 and longitudinal bracket mounting members 14 and 15 are provided with a suitable weather resistant coating, such as a powder coating, to provide an attractive weather resistant surface finish.

Figure 2:
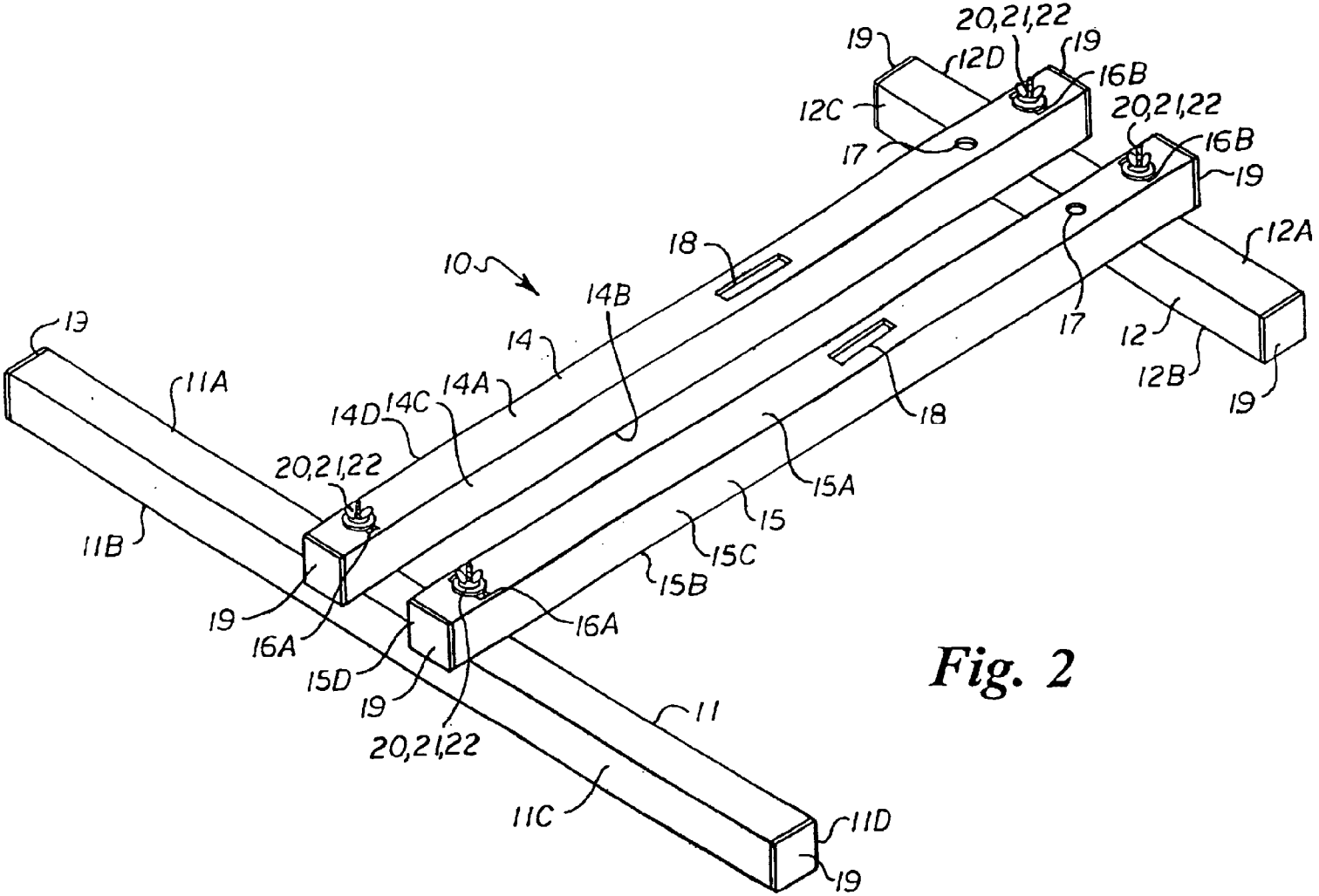
FIG. 2 is an isometric view of the portable adjustable stand for mounting and supporting a satellite dish antenna, shown in an assembled condition.

Referring now additionally to FIG. 2, the longitudinal bracket mounting members 14 and 15 are releasably connected to the top of the transverse cross members 11 and 12. The transverse slots 16A and 16B of the longitudinal bracket mounting members 14 and 15 are superposed over the laterally spaced holes 13 in the first and second transverse cross members 11 and 12 in vertical alignment. The shank of a threaded fastener 20 is inserted from the underside through each of the aligned holes 13 in the first and second transverse cross members 11 and 12 and slots 16A and 16B of the longitudinal bracket mounting members 14 and 15. A washer 21 and a wing nut 22 is installed on the outwardly extending end of each threaded fastener 19.

Figure 3:
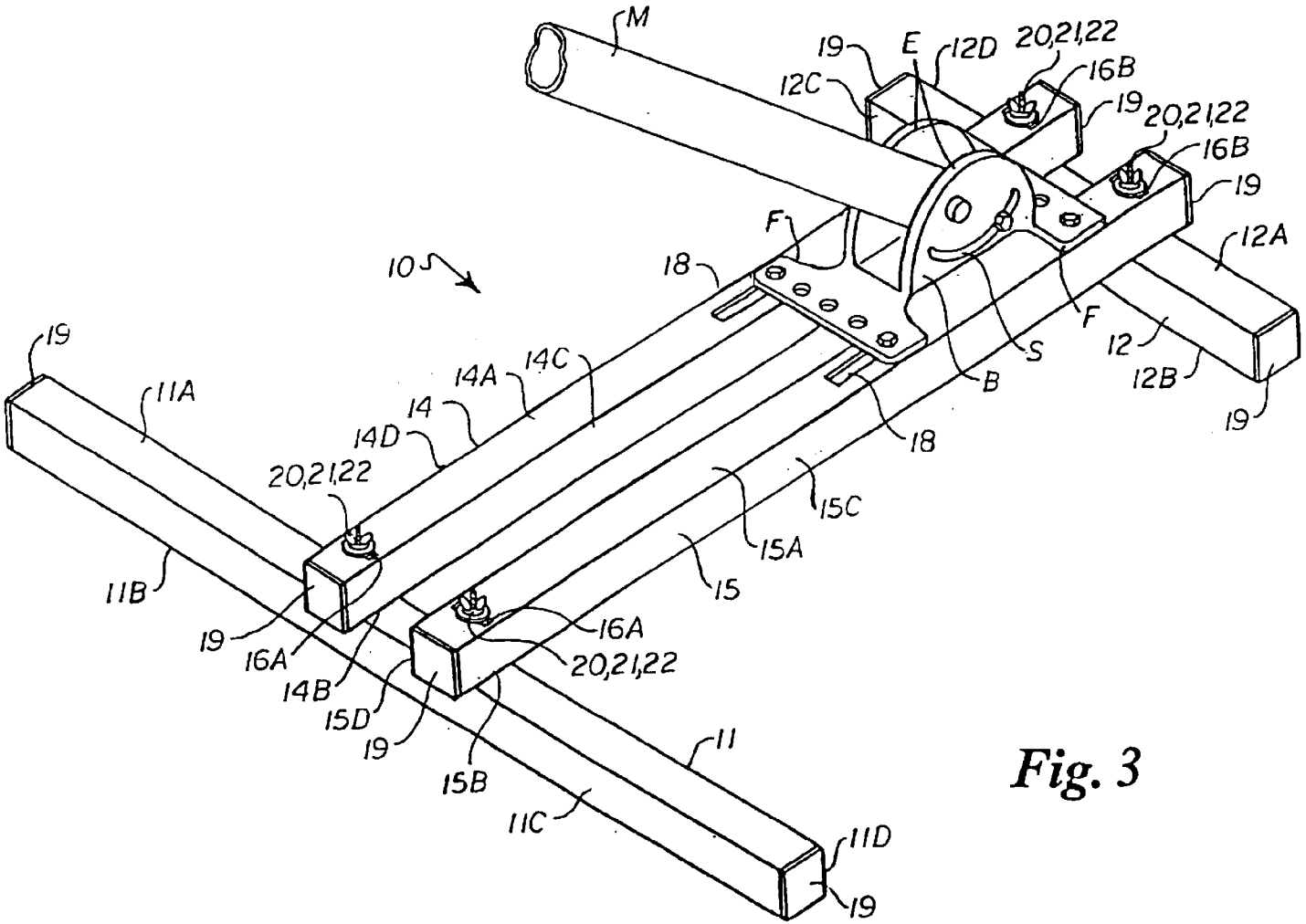
FIG. 3 is an isomeric view of the assembled portable adjustable stand for mounting and supporting a satellite dish antenna, showing the bracket at the lower end of the mast of the antenna mounted thereon.
Figure 4:
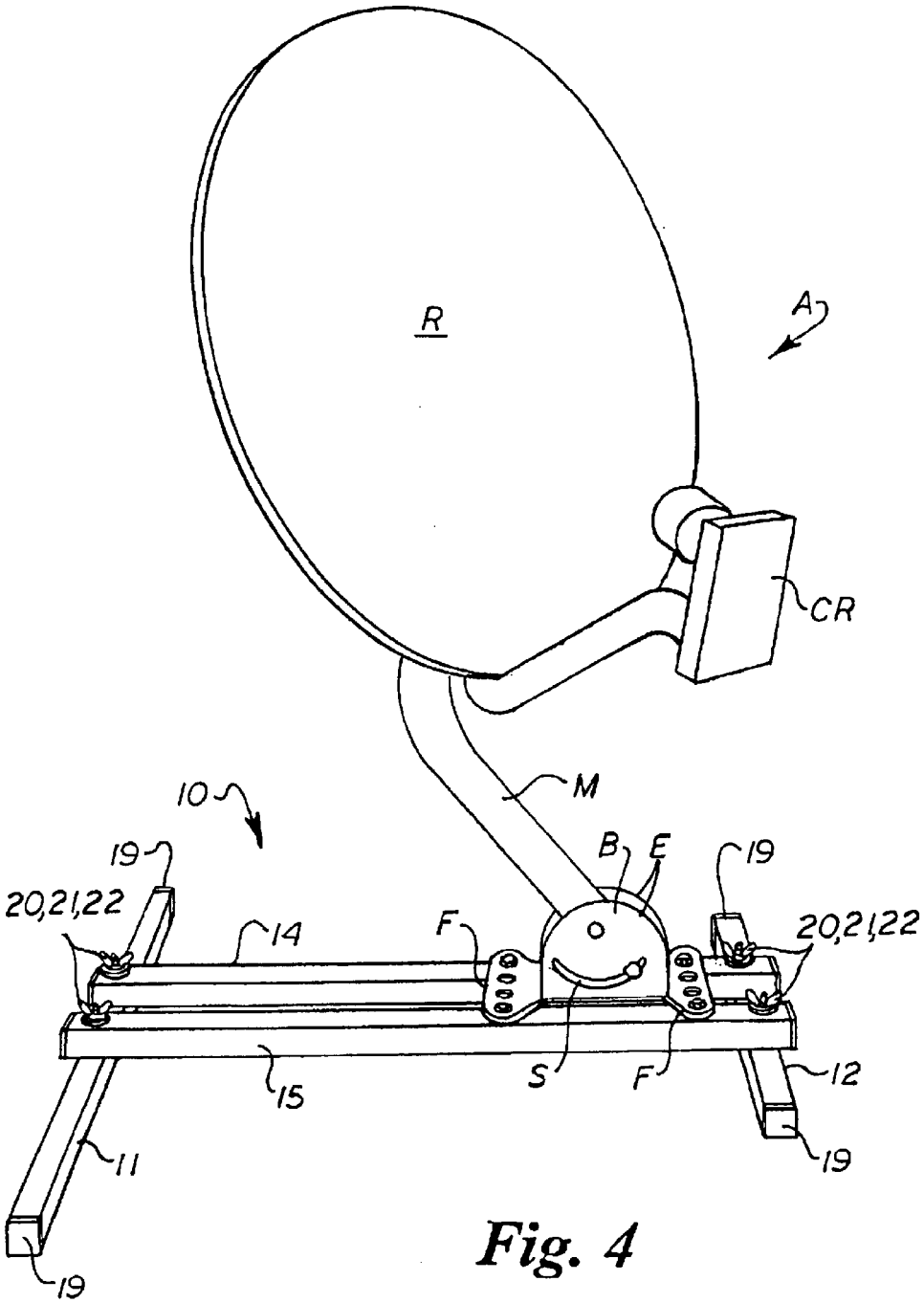
FIG. 4 is a perspective view of a satellite dish antenna mounted on the portable adjustable stand.

Referring now to FIGS. 3 and 4, the existing mounting foot or mounting bracket B of a typical commercial satellite dish antenna is shown mounted on the stand 10. The typical satellite dish antenna A comprises a parabolic reflector R and a low noise amplifier/block converter (LNB)/receiver CR mounted forwardly of the reflector. The parabolic reflector R is fixed to the upper end of a mast assembly arm M and the lower end of the arm is pivotally mounted in the mounting foot or mounting bracket B. The typical bracket B is of a generally U-shape having a pair of spaced parallel ears E which have arcuate slots S therein and a flange F at each end of the ears with apertures therethrough for receiving fasteners to mount the mast assembly arm M on a suitable supporting surface such as a roof, wall, floor, etc.

To mount the bracket B on the stand 10 of the present invention, the stand is assembled as described above but the wing nuts 22 are loosened to allow adjustment. The bracket B is positioned such that the mast arm M when installed therein will extend toward the longer transverse cross member 12. The bracket B is placed over the longitudinal bracket mounting members 14 and 15 the longitudinal bracket mounting members 14 and 15 are moved laterally such that their holes 17 and longitudinal slots 18 are vertically aligned with the outermost pairs of apertures in the flanges F at each end of the ears of the bracket. The shank of a threaded fastener F is inserted through each of the aligned apertures and holes 17 and slots 18, a washer and wing nut (not shown) is installed on the outwardly extending end of each threaded fastener F, and the wing nuts are tightened. Then the wing nuts 22 at each end of the longitudinal bracket mounting members 14 and 15 are tightened.

When properly assembled, the bracket B at the lower end of the mast arm M is releasably secured on the longitudinal bracket mounting members 14 and 15 inwardly a short distance from the shorter transverse cross member 11 and the mast arm extends toward the longer transverse cross member 12. The outer ends of the shorter transverse cross member 11 (approximately 12" long) and the outer ends of the longer transverse cross member 12 (approximately 24" long) extend laterally outward from the opposite ends of the longitudinal bracket mounting members 14 and 15 to provide lateral support against tipping over. The parabolic reflector R is typically from about 18" to 24" in diameter and the center of gravity of the mast arm M and reflector is generally centered over the center of the stand 10.

Thus, the present portable adjustable stand 10 provides a very stable support for a satellite dish antenna and allows it to be placed indoors or outdoors on a horizontal supporting surface, such as the floor of a dwelling, balcony, or patio and can be easily transported from one location to another.

While this invention has been described fully and completely with special emphasis upon a preferred embodiment, it should be understood that within the scope of the appended claims the invention may be practiced otherwise than as specifically described herein.

What is claimed is:

1. A portable adjustable stand for mounting and supporting a digital satellite dish of the type having a mast arm with a mounting foot or mounting bracket at a lower end thereof, comprising:

a first longitudinal cross member and a second longitudinal cross member adapted to be supported on a supporting surface in parallel spaced apart relation and each having opposed outer ends;

a pair of longitudinal bracket mounting members each having first and second ends and longitudinally spaced bracket mounting apertures therethrough, said first ends releasably and adjustably mounted on said first longitudinal cross member, and said second ends releasably and adjustably mounted on said second longitudinal cross member;

said pair of longitudinal bracket mounting members supported on said first and second cross members in parallel laterally spaced relation, and adapted to be adjusted laterally a distance apart to align said bracket mounting apertures with existing apertures in the mounting foot or mounting bracket at the lower end of the mast arm; and said first and second longitudinal cross members disposed transverse and perpendicular to said longitudinal bracket mounting members with their said opposed outer ends extending laterally outward a distance from outer sides thereof to provide a stable support.

2. The portable adjustable stand according to claim 1, wherein said first and second longitudinal cross members and said pair of longitudinal bracket mounting members are each formed of straight sections of tubing.

3. The portable adjustable stand according to claim 1, further comprising:

end caps on said outer ends of said longitudinal cross members and said first and second ends of said longitudinal bracket mounting members, respectively.

4. The portable adjustable stand according to claim 1, wherein said longitudinally spaced bracket mounting apertures of said longitudinal bracket mounting members comprise a hole formed therethrough a short distance inwardly from said second ends, and a longitudinal slot formed therethrough a short distance inwardly from said hole.

5. The portable adjustable stand according to claim 1, wherein said first and second longitudinal cross members each have a pair of laterally spaced apart holes therethrough intermediate their said opposed ends; and said longitudinal bracket mounting members each have a pair of transverse slots formed therethrough near their said first and seconds ends, respectively, each of said transverse slots superposed over a respective one of said laterally spaced holes in vertical alignment;

said first and second ends of said longitudinal bracket mounting members are releasably and adjustably mounted on said first and said second longitudinal cross members by respective fasteners extending through each of said aligned apertures and slots; and said longitudinal bracket mounting members are adjusted by loosening said fasteners and moving them laterally a distance apart to align their said bracket mounting apertures with the existing apertures in the mounting foot or mounting bracket, and thereafter tightening said fasteners.

6. The portable adjustable stand according to claim 1, wherein said pair of longitudinal bracket mounting members are of equal length; and said first longitudinal cross member has a length greater than the length of said second longitudinal cross member.

7. The portable adjustable stand according to claim 6, wherein said first longitudinal cross member has a length approximately twice the length of said second longitudinal cross member.

8. The portable adjustable stand according to claim 1, wherein said first longitudinal cross member has a length greater than the length of said second longitudinal cross member; and said pair of longitudinal bracket mounting members each have a length approximately the same length as said first longitudinal cross member.

9. A portable digital satellite dish antenna assembly, comprising;

a parabolic reflector mounted at an upper end of a mast arm having a lower end pivotally mounted in a mounting foot or mounting bracket;

a pair of straight longitudinal bracket mounting members releasably connected to said mounting foot or mounting bracket in parallel laterally spaced relation, each having first and second ends extending a distance outwardly from opposed ends of said mounting foot or mounting bracket;

a first longitudinal cross member releasably connected beneath said first ends of said longitudinal bracket mounting members and a second longitudinal cross member releasably connected beneath said second ends of said longitudinal bracket mounting members in parallel spaced apart relation, said cross members adapted to be supported on a supporting surface and each having opposed outer ends;

said pair of longitudinal bracket mounting members supported on said first and second cross members in parallel laterally spaced relation, and first and second longitudinal cross members disposed transverse and perpendicular to said longitudinal bracket mounting members with their said opposed outer ends extending laterally outward a distance from outer sides thereof to provide a stable support for said parabolic reflector and said mast arm.

10. The portable digital satellite dish antenna assembly according to claim 9, wherein said first and second longitudinal cross members and said pair of longitudinal bracket mounting members are each formed of straight sections of tubing.

11. The portable digital satellite dish antenna assembly according to claim 9, wherein said mounting foot or mounting bracket is releasably connected on said longitudinal bracket mounting members inwardly a short distance from one of said longitudinal cross members.

12. The portable digital satellite dish antenna assembly according to claim 9, wherein said pair of longitudinal bracket mounting members are of equal length; and said first longitudinal cross member has a length greater than the length of said second longitudinal cross member.

13. The portable digital satellite dish antenna assembly according to claim 9, wherein said first longitudinal cross member has a length approximately twice the length of said second longitudinal cross member.

14. The portable digital satellite dish antenna assembly according to claim 9, wherein said first longitudinal cross member has a length greater than the length of said second longitudinal cross member; and said pair of longitudinal bracket mounting members each have a length approximately the same length as said first longitudinal cross member.

* * * * *